US005228332A

United States Patent [19]

Bernhardt

[11] Patent Number: 5,228,332

[45] Date of Patent: Jul. 20, 1993

[54] GOLF PUTTER

[76] Inventor: Floyd V. Bernhardt, 5532 N. High School Rd., Indianapolis, Ind. 46254

[21] Appl. No.: 609,575

[22] Filed: Nov. 6, 1990

[51] Int. Cl.[5] ..... A63B 53/00

[52] U.S. Cl. ..... 73/65.03

[58] Field of Search ..... 73/65, 65.03; 273/80 A, 273/80 C, 167 F, 167 G

[56] References Cited

U.S. PATENT DOCUMENTS

| | | | |
|---|---|---|---|
| 3,497,220 | 2/1970 | Scott | 273/167 G |
| 4,163,554 | 8/1979 | Bernhardt | 273/80 C |
| 4,828,266 | 5/1989 | Tunstall | 273/171 |
| 4,866,979 | 9/1989 | Bernhardt . | |

FOREIGN PATENT DOCUMENTS

| | | | |
|---|---|---|---|
| 238646 | 10/1960 | Australia | 73/167 F |

OTHER PUBLICATIONS

Catalog page-publication unknown, from Tommy Armour Golf, date and page number unknown.

*Primary Examiner*—Herbert Goldstein

*Assistant Examiner*—Elizabeth L. Dougherty

*Attorney, Agent, or Firm*—Woodard, Emhardt, Naughton, Moriarty & McNett

[57] ABSTRACT

A method of manufacturing a golf putter with a true balance includes the steps of designing or selecting a particular shape and style of putter head and then providing a putter shaft with a substantially straight handle portion and a substantially straight neck portion which are integral with each other and arranged so as to define an included angle therebetween. With the putter and shaft defined, the front-to-rear and end-to-end center of gravity cutting planes are accurately determined as well as their line intersection. The point of attachment for the shaft to the head is then determined so that the longitudinal axis of the handle portion of the shaft passes through the line intersection of the two center of gravity cutting planes. Once the shaft is joined to the head with a slow-setting adhesive, the putter is set on a very flat and level test bed in order to test to see if there is any turning or rotation. If there is some slight turning or rotation of the putter head, a fine adjustment is made by rotating the shaft relative to the head until a true balance is achieved as determined by the test bed.

2 Claims, 5 Drawing Sheets

GOLF PUTTER

BACKGROUND OF THE INVENTION

The present invention relates in general to the design of golf clubs and in particular to the design of putters and a manufacturing method to insure that a true balance is achieved notwithstanding minor tolerance variations which typically occur during the manufacturing process.

The designs of golf clubs over the years have focused on numerous concepts which were believed to provide longer shots, more accurate shots, better control, better feel, more power and so forth. Quite often the design changes have involved a change of materials. Wooden shafts have given way to metal and now graphite. The heads of the woods and irons have undergone material changes as well as weight-distribution and shaping changes. These design evolutions have not been limited to the woods and irons, putters have seen as much if not more changes in their shapes and design theories over the years as any of the other clubs. One possible explanation for the extensive activity in the design of golf putters is the significance of this particular club relative to the other clubs when one considers the stroke count in a typical par round of golf. While the driver will typically be used 14 times and a 3-wood 4 or 5 times, other clubs such as the various irons may only be used a maximum 4 or 5 times in any one round of golf. The putter on the other hand is used at least 24 times and more likely 36 times (or more), assuming that for a par round the golfer reaches each green in regulation and is able to two-putt each green.

While the design change activities for golf have been directed to literally all phases of the game, including golf balls, not all design changes are good for all players because of physical differences and styles. Due to anatomical differences in players and the dynamics of their style of play, certain changes which have been made to the woods and irons are not well suited to every player. Consequently, numerous changes and variations have been offered by literally every manufacturer in an attempt to find a particular combination of features and design style which a large number of players like and hopefully prefer. The problem is that there is no common denominator as to a feature or features which everyone agrees is an absolute necessity. Some players still prefer metal shafts over graphite and some players still prefer laminated wood over metal heads for the driver and 2-5 "woods." The reason these players prefer the "older" design style is that they play better with these styles. Most golfers are not so vain as to stick with a wood or iron style for sentimental reasons if it is adversely affecting their play. Golfers like most other sportsmen continually look for the newest or latest development in hopes that the design changes will improve their game not only for a lower score but as well for the satisfaction of a well-struck shot and the enjoyment which that gives to a golfer. The level of play is all that matters to professional golfers, and thus if there was clearly a superior design style everyone would go to that style and yet as we know, this has not occurred.

While there is no common denominator for an essential design feature for woods or irons outside of the basics of a shaft and head and the necessary size and weight, there is a key or critical ingredient to the design of the best golf putter, and this ingredient is for the putter to possess a true balance. A putter's performance does not improve by the use of space age manufacturing techniques directed to shaping the head or extruding the shaft, etc. What really matters in the design of a golf putter is its balance. Only with a near-perfect or true balance can the golfer's success be controlled solely by the golfer's abilities. If a highly skilled golfer uses a putter which is not properly balanced, the putter will react by tending to turn or shift and while the golfer can manually override this tendency, it does influence the golfer's control, swing, and aim. In other words, can the golfer determine how much to alter or compensate an otherwise true swing or stroke in order to take into consideration the inherent turn or shift in the putter which results when the putter is not properly balanced?

If one looks at those putters with odd-looking, peculiar shapes, it should be clear that what the designer is trying to do is use shaping and weighting theories to try and achieve a true or perfect balance. In some instances, the shaping and styling of the putter is done with the objective of enhancing the golfer's aim feeling that if the golfer is able to maintain the putter in a particular direction during the swing, assuming that direction has been predetermined as a proper direction, then the resultant stroke will be somewhat more accurate. The problem though persists in that as the golfer swings the putter, if the putter is not properly balanced it will tend to turn or pivot in the golfer's hands and the golfer must adjust and compensate for this tendency. Numerous attempts have been made to try and guarantee the golfer a true and accurate swing, but how can this be done if the putter has a tendency to rotate or turn during a free swing such that the ball-striking face is not properly oriented at the point of contact? One problem in the past is that different manufacturers have different theories as to balance and while some degree of balance might exist in one plane of orientation for the putter, the dynamic balance of the putter swing has been ignored.

In my earlier U.S. Pat. No. 4,866,979, I disclose an apparatus which is designed to reveal the true balance of golf putters as they swing in a manner which accurately simulates a putter stroke. The putter under examination is installed into a holder which is set at an inclined angle and pivotally attached to an upright support. As the putter is drawn up and away, and then released and swings, if true balance does not exist the putter will turn or rotate in the holder thereby revealing the fact that the putter is not balanced in the only mode of balance that really matters, namely dynamic balance during the swing or stroke motion.

My balance-revealing invention for golf putters has been successfully used by pro shops and by companies in order to compare the balance of various putters. Various putters which the designer, manufacturer or user may have claimed to be balanced have been shown to be unbalanced by my apparatus. This unbalanced condition is disclosed during the simulated putter stroke by the putter actually turning in the apparatus as is fully described in U.S. Pat. No. 4,866,979. What happens is that at the point of contact with the ball, the putter head is oriented in a totally unacceptable position and use of this invention allows one to compare the degree of balance of various competing putters.

Since achieving a true balance for golf putters is important regardless of personal preferences in the size and shape of the putter head and regardless of the stroke style, it is important to be able to control the balance during the manufacturing process. While my balance-revealing apparatus invention will tell when the manufacturing process has failed, it is then too late. Further, even a precisely dimension and style putter can encounter minor variations in weight distribution due to casting tolerances, porosity, etc. which will throw off the anticipated balance or center of gravity.

The present invention discloses a manufacturing method which enables one to adjust the relationship of the head and shaft in order to compensate for minor tolerance and weight distribution variations which if left alone would create an unbalanced putter. In the manufacture of golf putters, once the shaft is rigidly fixed to the putter head, precise adjustments cannot be made in any realistic fashion or manner.

Also disclosed by the present invention is an automatic apparatus for testing and comparing the balance of a plurality of golf putters. This apparatus is based on my earlier invention of U.S. Pat. No. 4,866,979 with the addition of a linkage arm to interconnect each holder and a motor drive to automatically create the desired swing for all the putters simultaneously.

SUMMARY OF THE INVENTION

A method of manufacturing a golf putter with a true balance according to one embodiment of the present invention comprises providing a putter head of a desired size and shape, providing a putter shaft arranged with a substantially straight handle portion and a substantially straight neck portion set at an inclined angle relative to the handle portion, determining the front to rear and end to end centers of gravity for the putter head, establishing the point of attachment of the neck portion to the putter head based on the locations of the centers of gravity and turning the putter head and shaft relative to each other in order to make any necessary adjustments so as to achieve a true balance for the putter.

One object of the present invention is to provide an improved method of manufacturing a golf putter in order to achieve a true balance.

Related objects and advantages of the present invention will be apparent from the following description.

DESCRIPTION OF THE PREFERRED EMBODIMENT

Figure 1:
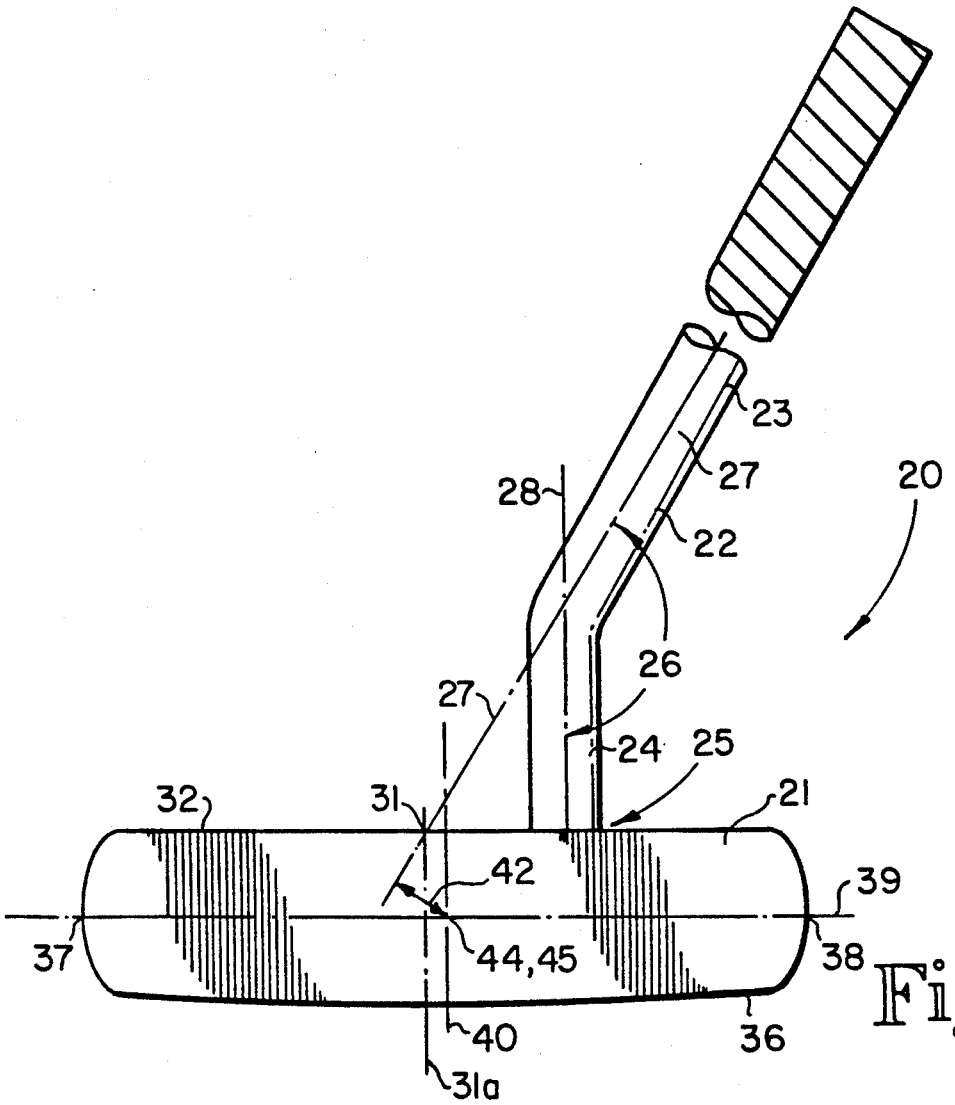
FIG. 1 is a front elevational view of a golf putter according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a golf putter 20 which includes head 21 and rigidly connected thereto shaft 22. As is illustrated shaft 22 includes a main body portion 23 which is the normal elongated handle or shaft portion which is grasped by the golfer and used to establish a stroke or swing to the club head 21. Disposed at the distal end of the main body portion is a shaft neck 24 which is attached to putter head 21 at point of attachment 25. In the illustrated embodiment, the main body portion 23 of the shaft 22 is at an incline angle while the neck portion 24 is substantially vertical relative to a generally horizontal ground surface. Although the main body and neck are integrally formed members as part of a unitary shaft, they do define an included angle 26 which extends between longitudinal axis 27 of the main body portion 23 and the vertical axis 28 of the neck portion 24. Due to included angle 26, the longitudinal axis 27 of the shaft main body portion 23 defines a point of intersection 31 in the upper or top surface 32 of head 21.

Figure 2:
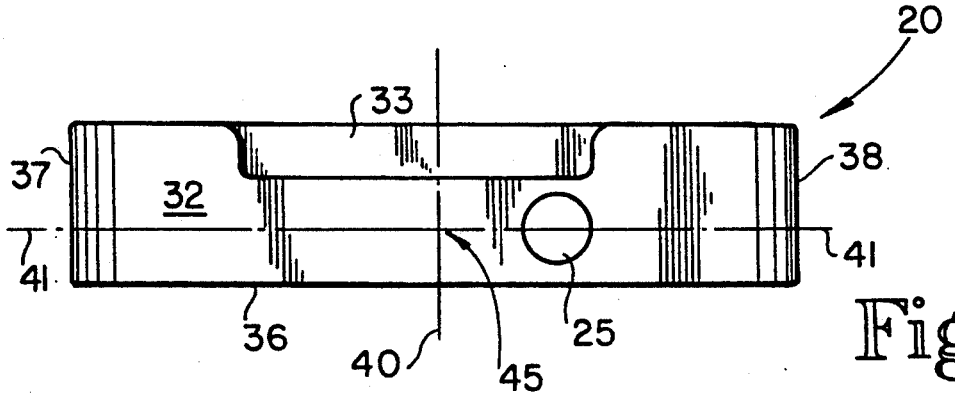
FIG. 2 is a top plan view of the FIG. 1 golf putter.
Figure 3:
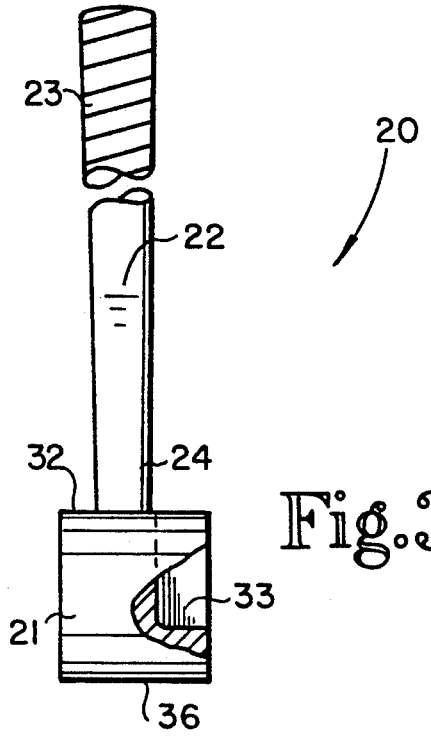
FIG. 3 is an end elevational view of the FIG. 1 golf putter.
Figure 4:
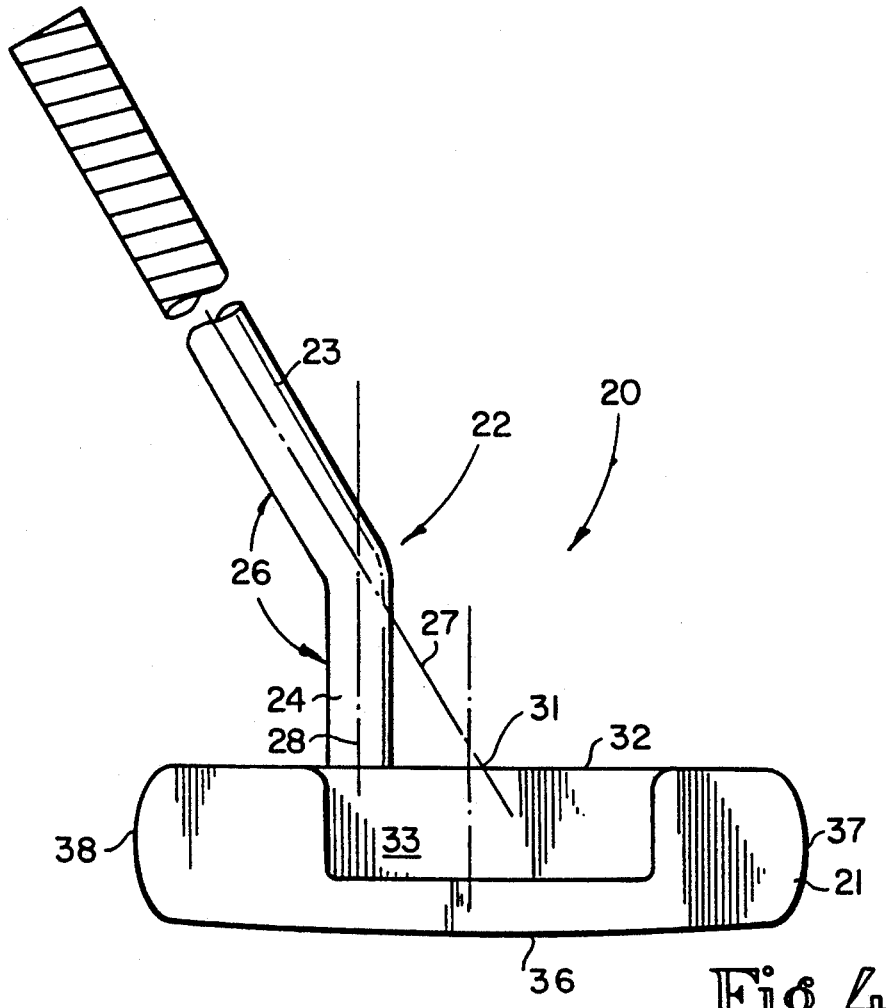
FIG. 4 is a rear elevational view of the FIG. 1 golf putter.

Referring to FIGS. 2, 3 and 4, a top plan view, end elevational view and rear elevational view of golf putter 20 are illustrated. It is to be noted that FIG. 2 has been drawn with shaft 22 omitted showing only in circular form the location for the point of attachment 25. Similarly, only a portion of shaft 22 is shown in FIG. 3. In FIGS. 2–4, one feature of the golf putter 20 is illustrated, that being a recessed or hollowed out back surface as indicated by recess 33.

While the teachings of the present invention are applicable to virtually any size or shape putter head, recess 33 is included in part to show how the present invention is applicable to a putter head which is not geometrically symmetrical about all planes. By providing recess 33 which is of a generally rectangular solid shape, it should be understood that this may be raised or lowered off the centerline between the top surface 32 or the bottom surface 36 of the putter head. Rectangular recess 33 may also be shifted between outer end 37 and inner end 38 so as to be nonsymetrical in that direction as well. Other shapes may be used for recess 33 such as semi-cylindrical recess. Again, the point being simply to illustrate that the present invention and its manufacturing method for achieving a true balance for the putter is achievable regardless of the shape irregularities or recesses in the putter construction.

Putter head 21, regardless of any nonuniformity or recesses or other irregularities in its geometric shape, is in fact a geometric solid consisting of three dimensional planes. Each of these three planes is capable of defining a cutting plane for passing through the putter head along the center of gravity so as to split the putter head into two halves where the weight of each half is the same. In order to further explain and discuss this particular concept, reference is made to broken lines 39, 40 and 41 as illustrated in FIGS. 1 and 2. Horizontal broken line 39 is intended to represent the center of gravity cutting plane for head 21 between top surface 32 and bottom surface 36 such that the mass or weight of head 21 above line or plane 39 is the same as that below plane 39. Consequently, if the putter head was turned on end, and a support point positioned along plane 39, the putter head will be balanced so as not to tip to one side or the other. Similarly, considering broken line 40 which represents a vertical center of gravity cutting plane (understanding that the shaft is omitted in this discussion, since we are only balancing the head), that portion of the putter head to the left of plane 40 or toe would be of equal weight and balance with that portion of the putter head to the right of plane 40 or heel. Finally, another vertical cutting plane, though turned 90 degrees from plane 40 is represented in FIG. 2 by broken line 41. This cutting plane passing through the center of gravity provides a weight distribution and balance between the ball-striking front face of the putter and the rear surface. In particular, it is worth noting that in view of recess 33 disposed in the rear surface of the putter head, this cutting plane line 41 is shifted more to the front than what would otherwise appear to be the geometric centerline of the overall putter head.

While focusing on the three geometric planes that each center of gravity plane corresponds to enables a straight shaft to be positioned for a true pendulum swing, a bent shaft as in FIG. 1 poses a different concern. If shaft axis 27 intersects top surface 32 at plane 40, there will be too much toe weight and a true swing will not be achieved.

For the majority of putters, a near balanced condition and true swing will result when neck portion 24 of shaft 22 is attached to head 21 so that a plane as represented by line 31*a*, constructed normal to the ball-striking front face, passes through the point of intersection 31 of axis 27. Plane 31*a* divides the putter into two portions, a left toe portion and a right heel portion. The left toe portion comprises approximately 39 to 43 percent of the putter head's weight, and in the preferred embodiment, comprises 41 percent of the putter head's weight.

As is believed to be well known when X, Y and Z cutting planes are considered together such that all three are intersecting, the intersection is a point and that point represents a center of gravity (center of mass) of the entire object, in this case the golf putter head 21. Referring briefly to FIG. 1, it should be understood that cutting plane line 39 represents a plane normal to the plane of the paper as does cutting plane line 40 though rotated 90 degrees from the orientation of line (cutting plane) 39. As a result, the intersection of these two cutting planes represented by point 44 is in fact a line whose orientation is normal to or into the plane of the paper. Next consider the cutting plane represented by broken line 41 and the fact that it is drawn in FIG. 2 which represents a top plan view. The point being made is that this particular plane will come down in FIG. 1 in a direction in the plane of the paper and will cut through the line intersection represented by point 44 thereby establishing the singular point 45 which is the center of gravity of the entire putter head.

Another point which should be understood is that in trying to establish a true balance for the putter so that the dynamics of the swing will not be influenced by anything other than the golfer's own abilities, there is an optimum balance condition that defines the desired relationships between the center of gravity 45, the longitudinal axis 27 of the main body portion 23 and the point of intersection 31. Equations of motion can be applied to describe the swinging action of a putter to demonstrate the importance of these relationships. These equations are easily applied by those persons skilled in the art; however, a brief description of the equations and their solutions will demonstrate the sensitivity of the putter head orientation at the point of impact to putter head misalignment.

By summing the inertial, frictional, and the external moments caused by gravity and linear acceleration forces, an equation of motion can be developed to describe the putter head orientation in response to a forcing function simulating a golfer's swing. This equation is a nonlinear differential equation whose solution can be easily derived by linearizing the equation for small motions. The resulting linear equation can then be algebraically solved by applying Laplace Transformations.

Given a typical putter an equation of motion can be derived. Referring now to FIG. 1, the solutions to this equation show that the orientation of the putter head at the point of impact is dependent on the distance 42 from the longitudinal shaft axis 27, as dictated by the point of attachment 25 and the included angle 26, to the center of gravity of the putter as defined by point 45. If this distance is not correct the putter head will not be at the desired orientation, and the putter face will be either open or closed at the point of impact. Given a typical putter, one solution might show that a putter head misalignment of 1/32" (0.03125 In.) can result in the putter head being open by six degrees at the point of impact.

As should be understood, with a fixed included angle 26 the point of intersection 31 of the axis 27 with top surface 32 depends on the length of the neck portion 24. By varying the neck portion length above surface 32, axis 27 can be fine tuned to intersect surface 32 at point 31 (plane 31*a*). This fine tuning can be achieved by changing the length of neck portion 24 which could include varying the depth the neck portion is inserted into head 21.

While it is anticipated that the specific geometry of each putter head can be precisely defined and constructed and while computer-aided design and computer-aided manufacturing techniques may be employed in order to precisely locate the center of gravity cutting planes 39, 40 and 41, and while these techniques can be used to accurately locate the proper position for the point of attachment 25 based upon a particular club geometry, shaft style and included angle between the main body and neck, some variation will nevertheless occur simply due to manufacturing tolerances. For example, if the putter head is to be cast from some metal alloy, the specific material composition may have a slightly different density over that computed by the CAD/CAM procedures or the amount of material to be cast may have some weight variation or there may be porosity in the actual cast head which would not be in the same location each time thus throwing off the precisely computed center of gravity very slightly. If multiple dies are being used for the casting of the putter head, there may be some tolerance variation from die to die and there may be certain machining variations in the precise location of the point of attachment 25. It is envisioned that this particular point of attachment will be a blind hole and its precise location relative to a particular putter head may vary as any kind of manufacturing or machining procedures have some tolerance variations associated with them.

The point which is being made is that virtually any putter of any size, shape or configuration may be accurately and precisely detailed by CAD/CAM techniques so as to define all the desired characteristics such as the point of attachment, included angle, centers of gravity, etc. and yet even knowing this information it may not be realistic to manufacture each golf putter with extremely tight tolerances. There must be some logical trade off between putter cost and manufacturing tolerances such that holding every dimension to one or two ten thousandths of an inch may increase the cost so dramatically that the putters are unaffordable. The obvious down side risk to streamlining the manufacturing process so as to allow or enable the use of wider tolerances is that a perfect balance will typically not be achieved.

Figure 5:
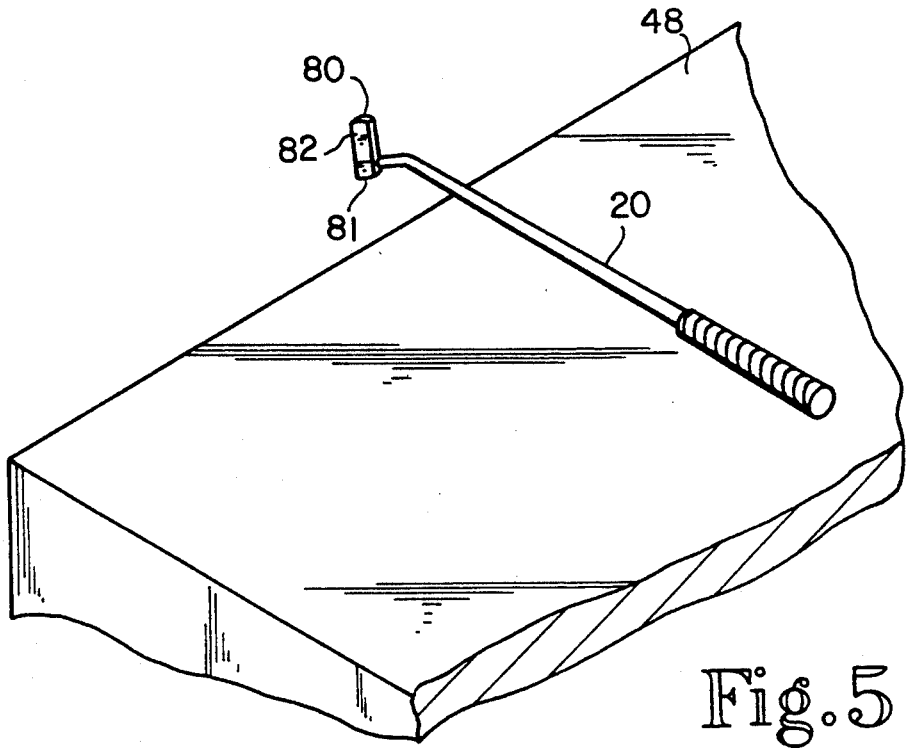
FIG. 5 is a diagrammatic illustration of a balancing table for use with the FIG. 1 golf putter in order to test for a true balance.

In the typical manufacturing process for those companies which are not aware of the importance of the true balance or not sensitive to the criticality of minor tolerance variations, the putter heads are produced in large volume with the blindhole provided and the shaft merely stuck in the hole and rigidly fixed. There is no final adjustment to achieve a true balance and in many instances none is possible due to the finality of the assembly step of attaching the shaft to the head. In contrast, in the present invention, a slower setting adhesive is used for attaching the shaft to the head at point of attachment 25. While the putters may be produced in the manner described with reasonably tight tolerances, the final step which enables a true balance to be achieved is described herein with reference to FIGS. 5-9. Once the putter shaft is installed in the blind hole in the putter head in a manner as precise and accurate as possible using an adhesive cement, the putter is laid on an extremely flat and smooth and level surface illustrated in FIG. 5 such that any rotation or turning of the putter head will be reflected only by an imbalance in the weighting of the head relative to the shaft, its point of attachment and the included angle. Although the putter head 21 can be positioned either with toe 80 positioned either up or down, in the preferred embodiment FIG. 5 shows putter 20 with the toe 80 of putter head 21 oriented up, the heel 81 of putter head 21 oriented down and face 82 of putter head 21 normal or perpendicular to surface 48. With toe 80 positioned above surface 48, any imbalance will result in a visible rotation of toe 80 to a downward resting position. Toe 80 positioned down will also result in a rotation of the putter because of the imbalance; however, this rotation will be slight as the putter head 21 will only be rotating a very slight amount until it is at its downward resting position. Test surface 48 needs to be very precisely established as to its flatness and level nature so that it does not introduce any rotation or turning of the putter which might cause an otherwise balanced putter to be changed. The manufacturer then takes any putter which has turned or rotated slightly from the above described orientation indicating that it does not possess a true balance and slightly, very slightly turns the shaft in the head at the point of attachment.

Figure 6:
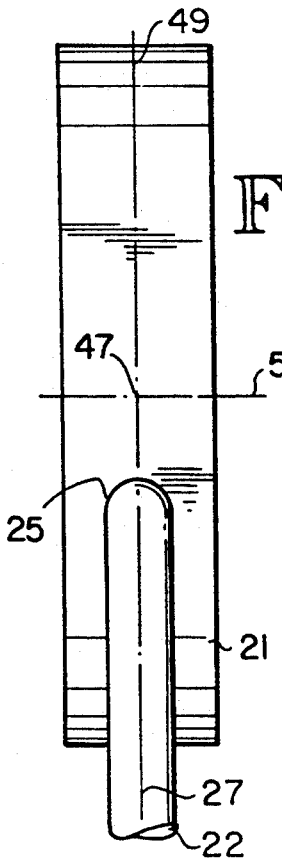
FIG. 6 is a schematic illustration of a top plan view indicating the relative positions of the shaft axis and putter head center of gravity.
Figure 8:
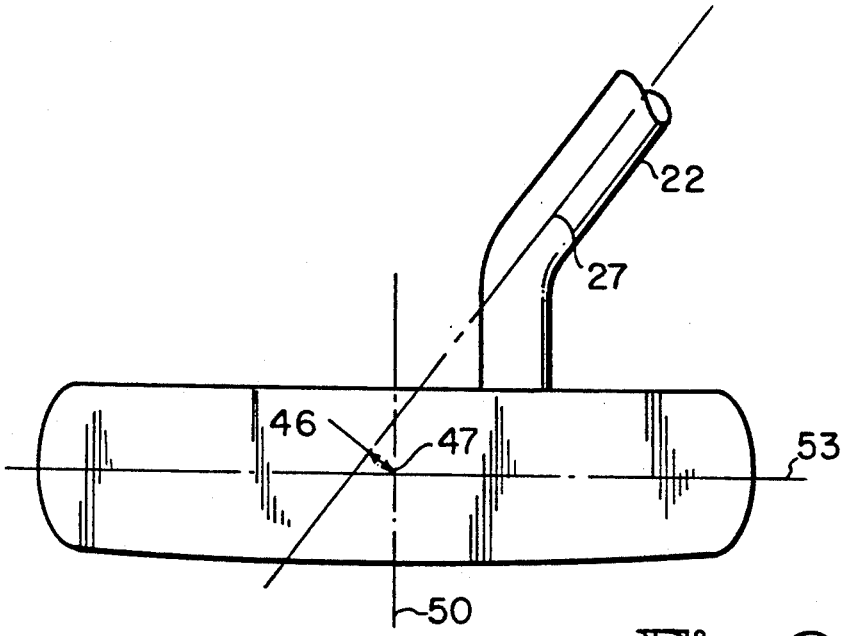
FIG. 8 is a schematic illustration of a front elevational view indicating the relative positions of the shaft axis and putter head center of gravity.

Referring now to FIG. 6 and FIG. 8, FIG. 6 illustrates the alignment of shaft 22 in point of attachment 25 relative to head 21 wherein the longitudinal axis 27 of the main body portion 23 is shown as being on line with center of gravity cutting plane 49. FIG. 8 shows that when shaft 22 is aligned as depicted in FIG. 6, an optimum distance 46 is created between the longitudinal axis 27 and the center of gravity 47. With this alignment the putter is balanced because the optimum distance 46 has been achieved. The cutting planes 49, 50 and 53 illustrated in FIG. 6 and FIG. 8 represent those that are assumed to be true or correct based upon the original CAD/CAM design process.

Figure 7:
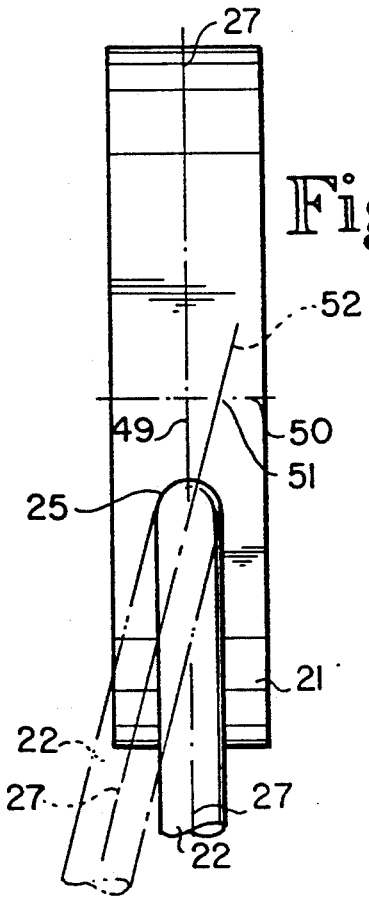
FIG. 7 is a schematic illustration showing the rotational adjustment of the shaft in order to create a true balance for the putter head of FIG. 6.
Figure 9:
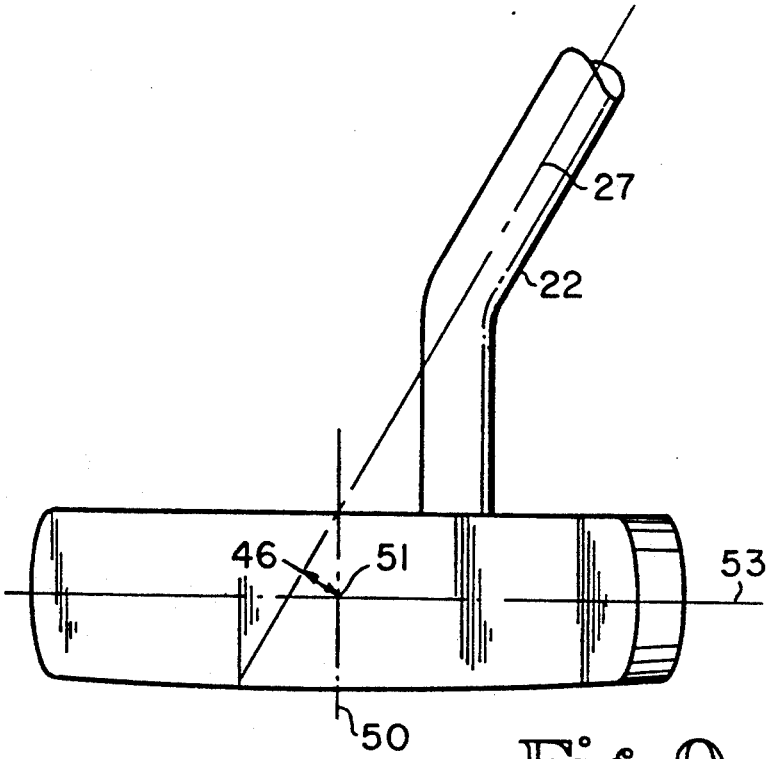
FIG. 9 is a schematic illustration of a front elevational view indicating the relative positions of the shaft axis and putter head center of gravity after the rotational adjustment shown in FIG. 7 is made.

However, reference to FIG. 7 shows that the actual center of gravity point 51 is very slightly shifted off of what would otherwise been assumed to be the true or proper intersection point. Consequently, in order for this putter to have a true balance, it is necessary for the longitudinal axis 27 to rotated until the longitudinal axis 27 and the center of gravity lie in a common plane as represented by cutting plane 52. In this respect, cutting plane 52 in FIG. 7 is analogous to cutting plane 49 in FIG. 6. FIG. 9 shows that when shaft 22 is thus aligned, the optimum distance 46 is again created between the longitudinal axis 27 and the center of gravity 51. Although there can be envisioned those instances where center of gravity 51 is shifted sufficiently so that rotation of shaft 22 can never result in distance 46 being achieved, the procedure outlined will still always improve a putter's balance, and because in the majority of cases the shift of center of gravity 51 will be small, the procedure outlined will result in a balanced putter. For this particular process to be tested, since the center of gravity 51 is not a point which can be visually seen, it must be done by the test bed of FIG. 5. The manufacturer makes minor turning adjustments of the shaft in the head until the putter under test remains stationary on the test bed without any turn or rotation. This particular process works extremely well since the point of attachment is predetermined based upon the particular putter geometry, the center of gravity of the head and the particular shaft style including the length of the neck portion and the included angle. As mentioned, even with all the care and preciseness taken to establish where the proper points should be and what the proper dimensions should be, minor manufacturing variations still exist. In order to make an absolutely perfect putter in the sense of true balance, it is important that some adjustment capability be provided. This adjustment capability is provided by using a slower curing adhesive compound so that at the final assembly stage, the shaft may be turned relative to the head or vice versa and fine-tuned until perfect balance is achieved based upon the lack of any turn or rotation of the putter when set up on the test fixture of FIG. 5.

Figure 10:
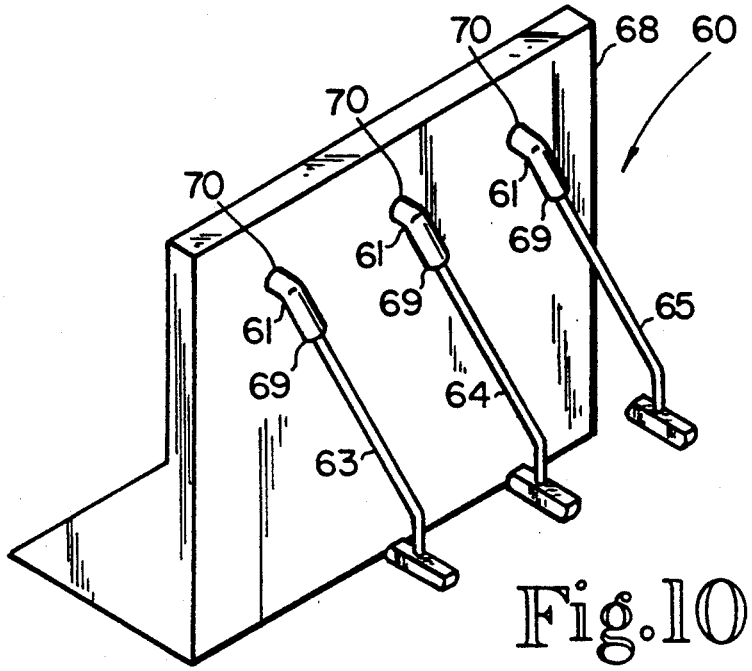
FIG. 10 is a diagrammatic illustration of a front perspective view of a multiple balance testing apparatus wherein three individual balance-revealing apparata are interconnected so as to move together simultaneously.
Figure 11:
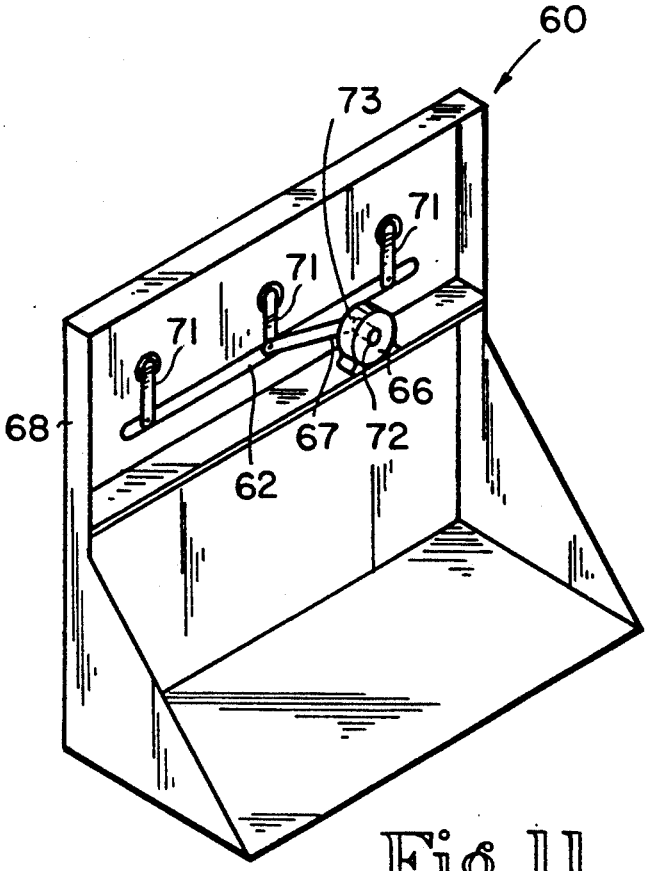
FIG. 11 is a diagrammatic illustration of a rear perspective view of the multiple balance testing apparatus shown in FIG. 10 wherein the connecting linkage and motor drive are depicted.

Referring to FIG. 10 and FIG. 11 there is illustrated a putter testing device 60 which includes the equivalent of three individual balance-revealing apparata 70 constructed according to the structure disclosed in U.S. Pat. No. 4,866,979 which patent is hereby incorporated by reference for the disclosure of that apparatus. The three apparata 70 are mounted in support panel 68 and are comprised of support arms 61 and tubular holders 69. Apparata 70 are interconnected via linkages 71 to linkage arm 62 so that they swing simultaneously and in a synchronous fashion. In this manner three different putters 63, 64 and 65 can be tested at the same time and compared relative to each other as to their respective degrees or extent of true balance. Motor drive 66 incorporates motor drive shaft 72 which in turn is connected via linkage 73 to rotation swing arm 67, thereby creating a reciprocating motion to automatically swing the three putters simultaneously.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of manufacturing a golf putter with a true balance comprising the following steps:

providing a golf putter head having a toe and a heel and a desired size and shape;

providing a golf putter shaft having a central longitudinal axis and arranged with a substantially straight handle portion and a substantially straight neck portion, said handle portion and said neck portion defining an included angle therebetween;

determining front-to-rear and toe-to-heel center of gravity planes for the golf putter head, said planes having an intersection which defines a center of gravity line;

determining a top-to-bottom center of gravity plane so that the intersection of said front-to-back, toe-to-heel, and top-to-bottom planes defines a center of gravity point;

establishing an attachment location for the neck portion of said golf putter shaft to said golf putter head based on a relationship between said attachment location and said center of gravity line, wherein said attachment location intersects said front-to-rear center of gravity plane and is between said center of gravity line and the heel of said golf putter head, said attachment location of said neck portion to said putter head is further based on a relationship between said axis and said center of gravity point, wherein said axis when extended passes through said golf putter head between said center of gravity point and the toe of said golf putter head; and adjusting said golf putter head and said golf putter shaft relative to each other, by rotating said neck portion within said putter head about a central longitudinal axis defined by said neck portion, thereby fine tuning said putter to achieve a true balance.

2. A method of manufacturing a golf putter with a true balance comprising the following steps:

providing a golf putter head having a toe and a heel and a desired size and shape;

providing a golf putter shaft having a central longitudinal axis and arranged with a substantially straight handle portion and a substantially straight neck portion, said handle portion and said neck portion defining an included angle therebetween;

determining front-to-rear and toe-to-heel center of gravity planes for the golf putter head, said planes having an intersection which defines a center of gravity line;

determining a top-to-bottom center of gravity plane so that the intersection of said front-to-back, toe-to-heel, and top-to-bottom planes defines a center of gravity point;

establishing an attachment location for the neck portion of said golf putter shaft to said golf putter head based on a relationship between said attachment location and said center of gravity line, wherein said attachment location intersects said front-to-rear center of gravity plane and is between said center of gravity line and the heel of said golf putter head, said attachment location of said neck portion to said putter head is further based on a relationship between said axis and said center of gravity point, wherein said axis when extended passes through said golf putter head between said center of gravity point and the toe of said golf putter head; and adjusting said putter head and said putter shaft relative to each other by both rotating said neck portion within said putter head about a central longitudinal axis defined by said neck portion and by translating said neck portion within said putter head along said axis, thereby fine tuning said putter to achieve a true balance.

* * * * *